US009618901B2

(12) United States Patent
Toyoizumi et al.

(10) Patent No.: US 9,618,901 B2
(45) Date of Patent: Apr. 11, 2017

(54) SHEET HUMIDIFICATION APPARATUS AND HUMIDIFICATION CONTROL METHOD

(71) Applicant: Konica Minolta, Inc., Tokyo (JP)

(72) Inventors: Teruhiko Toyoizumi, Tokyo (JP); Kenji Tamaki, Saitama (JP); Hirofumi Nakajima, Tokyo (JP); Tadashi Matsudaira, Tokyo (JP); Masaaki Uchiyama, Kanagawa (JP); Kosuke Sasaki, Kanagawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/143,119

(22) Filed: Apr. 29, 2016

(65) Prior Publication Data

US 2016/0320748 A1 Nov. 3, 2016

(30) Foreign Application Priority Data

May 1, 2015 (JP) ..... 2015-093956

(51) Int. Cl.
*G03G 21/20* (2006.01)

(52) U.S. Cl.
CPC ..... *G03G 21/203* (2013.01)

(58) Field of Classification Search
CPC ..... G03G 2215/00776; G03G 21/203
See application file for complete search history.

(56) References Cited

U.S. PATENT DOCUMENTS

| | | | | |
|---|---|---|---|---|
| 7,862,689 | B2 * | 1/2011 | Kawasaki | B41J 29/393 162/134 |
| 2006/0114302 | A1 * | 6/2006 | Holtman | B41J 2/17593 347/88 |
| 2015/0277307 | A1 * | 10/2015 | Goto | G03G 15/5095 399/49 |
| 2015/0362870 | A1 * | 12/2015 | Ogushi | G03G 15/1665 399/66 |
| 2016/0070224 | A1 * | 3/2016 | Takematsu | G03G 15/6576 399/406 |

FOREIGN PATENT DOCUMENTS

| | | |
|---|---|---|
| JP | 2007-292914 A | 11/2007 |
| JP | 2012-237924 A | 12/2012 |

* cited by examiner

*Primary Examiner* — Sevan A Aydin
(74) *Attorney, Agent, or Firm* — Osha Liang LLP

(57) ABSTRACT

A sheet humidification apparatus includes a detect sensor that detects a position of a sheet which is being conveyed; a humidifier that changes a humidification amount and humidifies the sheet; and a controller that controls the humidifier such that a first region on a front end side of the sheet in a conveyance direction is humidified with a first humidification amount, and a second region of the sheet other than the first region is humidified with a second humidification amount larger than the first humidification amount in accordance with a position of the sheet detected by the detect sensor.

11 Claims, 8 Drawing Sheets

| PARAMETER / POINT | DIAMETER OF HUMIDIFICATION ROLLER | SHEET TYPE | CHARGING VOLTAGE | IMAGE DENSITY | FIXING TEMPERATURE |
|---|---|---|---|---|---|
| +1 POINT | LARGE | THIN PAPER, COATED PAPER | HIGH | LOW (SMALL TONER AMOUNT) | HIGH |
| -1 POINT | SMALL | PLAIN PAPER, THICK PAPER | LOW | HIGH (LARGE TONER AMOUNT) | LOW |
FIG. 5
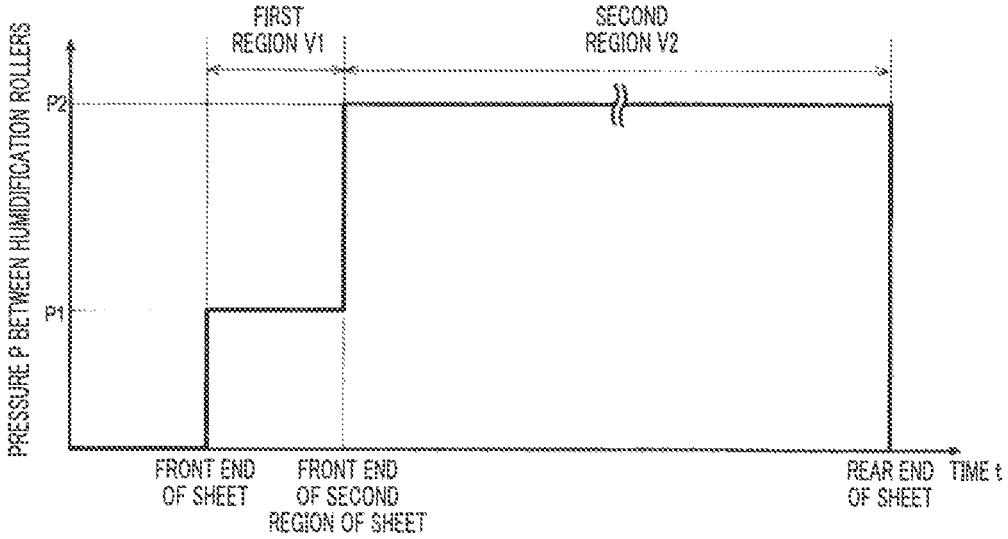
FIG. 6
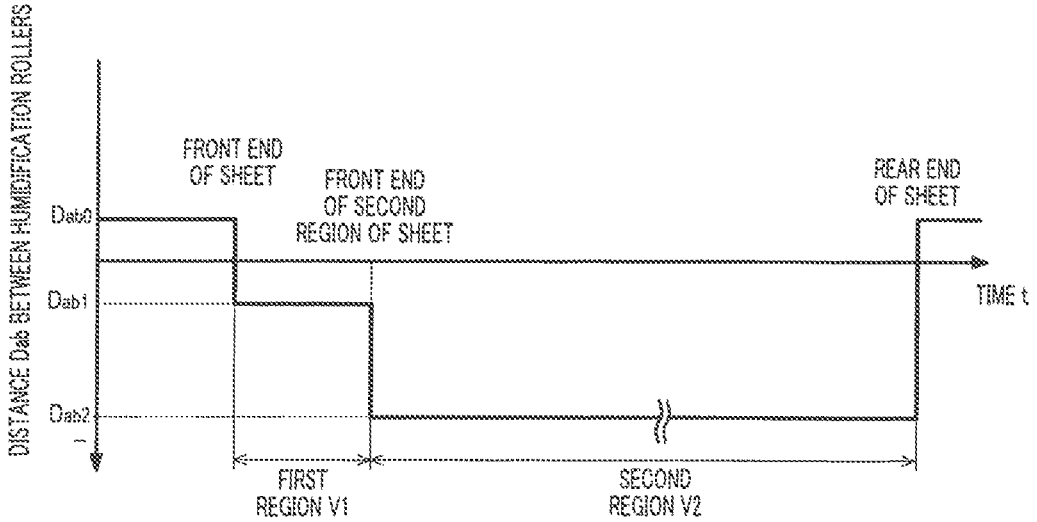
FIG. 7

SHEET HUMIDIFICATION APPARATUS AND HUMIDIFICATION CONTROL METHOD

CROSS REFERENCE TO RELATED APPLICATIONS

This application is entitled to and claims the benefit of Japanese Patent Application No. 2015-093956, filed on May 1, 2015, the disclosure of which including the specification, drawings and abstract is incorporated herein by reference in its entirety.

BACKGROUND OF THE INVENTION

1. Field of the Invention

The present invention relates to a sheet humidification apparatus and a control method thereof for humidifying a sheet on which an image has been formed.

2. Description of Related Art

In electrophotographic image forming apparatuses such as a copier, a printer, a facsimile machine apparatus, and a multifunctional device having such functions, the moisture of the sheet is reduced during a fixation process using heat.

As a result, the dried sheet may be curled or deformed into a wavy shape. In addition to the curl, the sheet may also have static electricity or heat resulting from the fixation processes. Consequently, jam may be easily caused, and the subsequent processes may be negatively influenced.

To solve the above-mentioned problems, a configuration for humidifying the sheet subjected to the fixation process has been proposed. Specifically, for the purpose of removing the curl of the sheet, discharging the sheet, and cooling down the sheet, the sheet is conveyed with moisturized humidification rollers to humidify the sheet. Instead of the configuration using the humidification roller, a method of spraying water vapor to the sheet has also been proposed.

Variations and approaches of such image forming apparatuses are disclosed in Japanese Patent Application Laid-Open No. 2007-292914 and Japanese Patent Application Laid-Open No. 2012-237924.

In Japanese Patent Application Laid-Open No. 2007-292914, the pressure contacting state of the draining roller on the humidification roller is switched in accordance with the condition of each sheet to control the humidification amount. In this case, humidification is appropriately performed in accordance with the upper limit of each sheet to prevent curling and waviness of the sheet, and ensure flatness.

In addition, in Japanese Patent Application Laid-Open No. 2012-237924, whether humidification is performed is switched according to the image formation of each sheet to prevent image defect.

In the above-mentioned manner, by humidifying the sheet output from the thermal fixation apparatus with the sheet humidification device, curling and waviness of the sheet and the like can be reduced and flatness can be ensured.

However, it is found that the sheet winds around the humidification roller under the influence of the water of the humidified sheet surface when the above-mentioned humidification is performed. Likewise, also in the case where the sheet is humidified by water vapor spraying, a situation where a sheet winds around the conveyance roller immediately after the humidification easily occurs.

Such sheet winding is a conveyance failure, and requires the operation of the apparatus to be stopped. In the case where the sheet humidification apparatus is a part of an image formation system, the entire operation of the image formation system has to be stopped, and the productivity disadvantageously decreases.

SUMMARY

In one or more embodiments of the present invention, a sheet humidification apparatus and a humidification control method can perform humidification of a sheet without negatively affecting sheet conveyance.

One or more embodiments of the above-described sheet humidification apparatus and the humidification control method are described as follows.

(1) A sheet humidification apparatus reflecting one aspect of the present invention includes: a detection section (detect sensor) configured to detect a position of a sheet which is being conveyed; a humidification section (humidifier) configured to be capable of changing a humidification amount and humidify the sheet; and a control section (controller) configured to control the humidification section such that a first region on a front end side of the sheet in a conveyance direction is humidified with a first humidification amount, and a second region of the sheet other than the first region is humidified with a second humidification amount larger than the first humidification amount in accordance with a position of the sheet detected by the detection section.

In addition, a humidification control method reflecting one aspect of the present invention is a method used in a sheet humidification apparatus including a detection section configured to detect a position of a sheet which is being conveyed, a humidification section configured to be capable of changing a humidification amount and humidify the sheet, and a control section configured to control the humidification section to humidify the sheet, and the method includes: causing the control section to control the humidification section such that a first region on a front end side of the sheet in a conveyance direction is humidified with a first humidification amount, and a second region of the sheet other than the first region is humidified with a second humidification amount larger than the first humidification amount in accordance with a position of the sheet detected by the detection section.

(2) In one or more embodiments of the invention, the humidification section includes a pair of humidification rollers configured to humidify the sheet when the sheet is conveyed in a sandwiching manner, and the control section switches between the first humidification amount and the second humidification amount by changing a contacting state of the humidification rollers with respect to the sheet.

In addition, in one or more embodiments of the invention, the humidification section includes a pair of humidification rollers configured to humidify the sheet when the sheet is conveyed in a sandwiching manner, and a water supply section configured to supply water to the humidification roller, and the control section changes water supply state from the water supply section to the humidification roller to switch between the first humidification amount and the second humidification amount.

(3) In one or more embodiments of the invention, the humidification section further includes a sandwiching adjustment section (sandwiching adjuster) configured to adjust a sandwiching pressure or a sandwiching distance of the sheet of the humidification rollers, and the control section adjusts the sandwiching pressure or the sandwiching distance of the humidification rollers by the sandwiching adjustment section to change the contacting state and switch between the first humidification amount and the second humidification amount.

(4) In one or more embodiments of the invention, the control section adjusts the sandwiching pressure or the sandwiching distance of the humidification rollers by the sandwiching adjustment section and changes a contact area of the sheet and the humidification rollers to switch between the first humidification amount and the second humidification amount.

(5) In one or more embodiments of the invention, the control section refers to a diameter of the humidification rollers to control a timing of switching between the first humidification amount and the second humidification amount.

(6) In one or more embodiments of the invention, the control section refers to a diameter of the humidification rollers to determine the first humidification amount.

(7) In one or more embodiments of the invention, the control section refers to the second humidification amount to control a timing of switching between the first humidification amount and the second humidification amount.

(8) In one or more embodiments of the invention, the control section refers to a type of the sheet to control a timing of switching between the first humidification amount and the second humidification amount.

(9) In one or more embodiments of the invention, the control section refers to an image formation condition in a case where an image is formed on the sheet to control a timing of switching between the first humidification amount and the second humidification amount.

In addition, in the above-mentioned humidification control method according to one or more embodiments of the invention, the humidification section includes a pair of humidification rollers configured to humidify the sheet when the sheet is conveyed in a sandwiching manner, and the control section operates to change a contacting state of the humidification rollers with respect to the sheet to switch between the first humidification amount and the second humidification amount.

BRIEF DESCRIPTION OF DRAWINGS

FIG. 5 is an explanatory diagram illustrating determination of an operation of the sheet humidification apparatus of one or more embodiments of the present invention;

FIG. 6 is an explanatory diagram illustrating an operation state of the sheet humidification apparatus of one or more embodiments of the present invention;

FIG. 7 is an explanatory diagram illustrating the operation state of the sheet humidification apparatus of one or more embodiments of the present invention;

DETAILED DESCRIPTION

In the following, embodiments of the present invention will be described in detail with reference to the accompanying drawings. Here, the embodiments will be described in detail with reference to image formation system 1 including sheet humidification apparatus 200.

[Configurations of Image Formation System and Sheet Humidification Apparatus]

Figure 1:
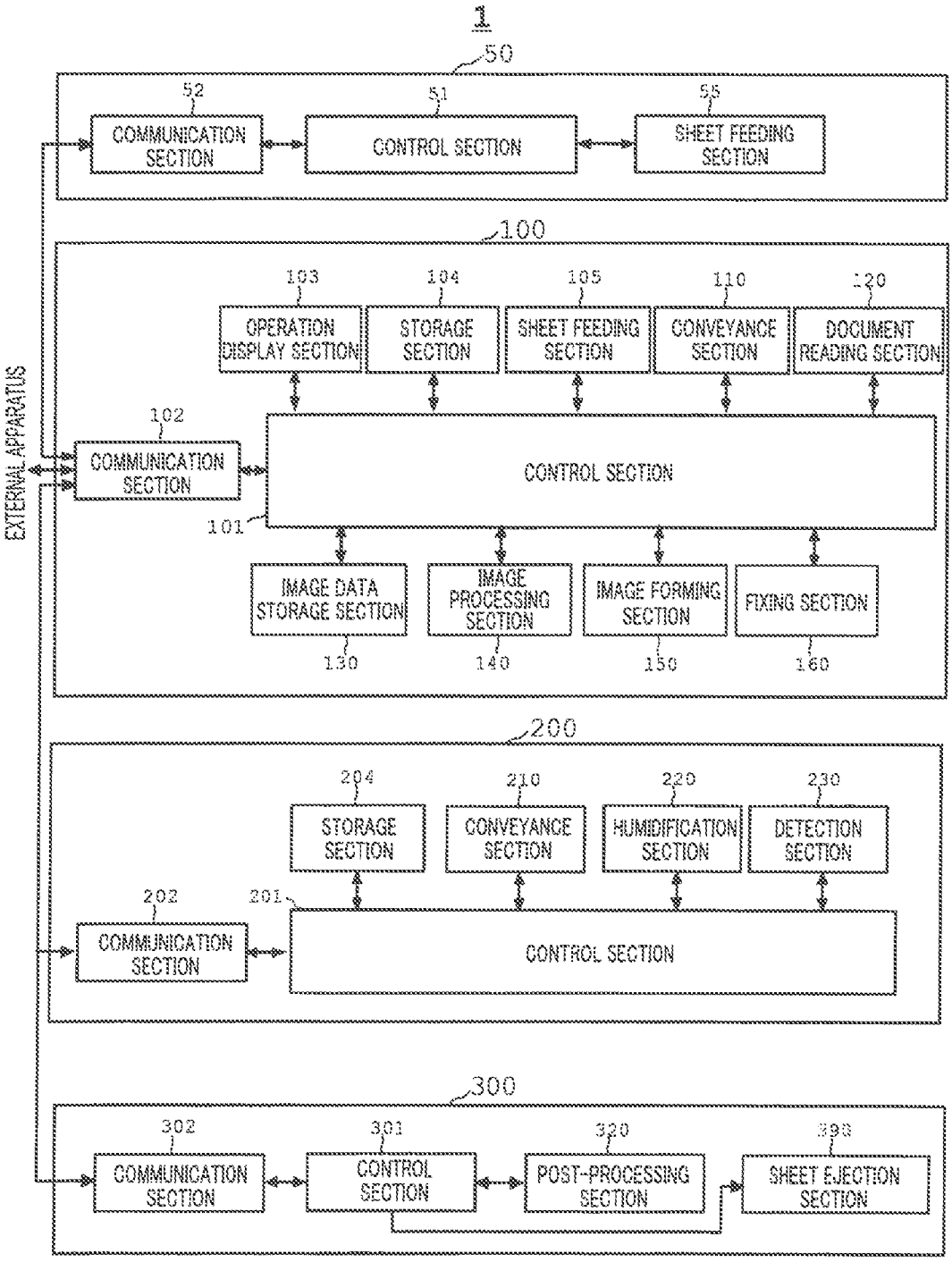
FIG. 1 illustrates a configuration of a sheet humidification apparatus of one or more embodiments of the present invention.
Figure 2:
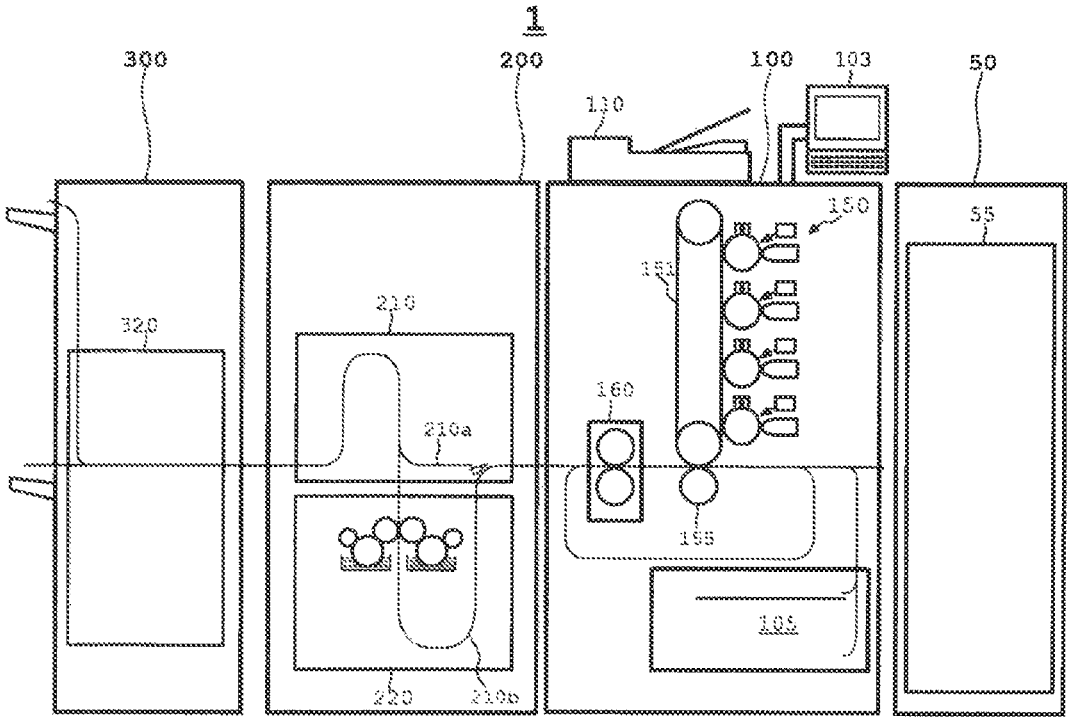
FIG. 2 illustrates a configuration of the sheet humidification apparatus of one or more embodiments of the present invention.
Figure 3:
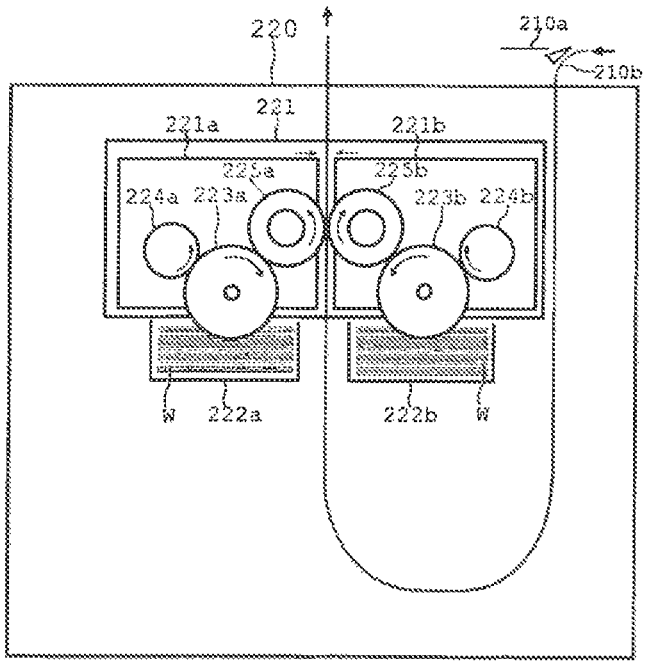
FIG. 3 illustrates a configuration of the sheet humidification apparatus of one or more embodiments of the present invention.

With reference to FIG. 1 to FIG. 3, a configuration of image formation system 1 including sheet humidification apparatus 200 according to one or more embodiments of the invention will be described.

As illustrated in FIG. 1 and FIG. 2, image formation system 1 includes sheet feeding apparatus 50, image forming apparatus 100, sheet humidification apparatus 200, and after-treatment apparatus 300.

Sheet feeding apparatus 50 includes control section 51, communication section 52 and sheet feeding section 55. Here, control section 51 performs a control relating to sheet feeding. Communication section 52 communicates with other apparatuses. Under the control of control section 51, sheet feeding section 55 feeds a sheet to sheet image forming apparatus 100.

Image forming apparatus 100 includes control section 101, communication section 102, operation display section 103, storage section 104, sheet feeding section 105, conveyance section 110, document reading section 120, image data storage section 130, image processing section 140, image forming section 150, and fixing section 160. A sheet on which an image has been formed in image forming apparatus 100 is conveyed toward the succeeding apparatuses.

Here, control section 101 controls each section in image forming apparatus 100, and the entire image formation system. Communication section 102 communicates with other apparatuses connected thereto. Operation display section 103 informs control section 101 of an operation input signal corresponding to an operation input by an operator, and performs notifications, warnings, and status display of image forming apparatus 100. Storage section 104 stores a control program and various kinds of setting data, and serves as a work area of the control program. Sheet feeding section 105 feeds stored sheets toward image forming section 150. Conveyance section 110 conveys a fed sheet on which to form an image at a predetermined speed. Document reading section 120 scans a document and generates image data. Image data storage section 130 stores various kinds of data and image data for image formation. Image processing section 140 executes various kinds of image processes required for image formation. Image forming section 150 executes printing through image creation, transferring, and fixation (hereinafter referred to as "image formation") on the basis of an image formation command and image data after image processing. With heat and pressure, fixing section 160 stabilizes an image transferred on the sheet.

Sheet humidification apparatus 200 is provided at a position succeeding image forming apparatus 100 in the sheet conveyance direction. Sheet humidification apparatus 200 includes control section (controller) 201, communication section 202, conveyance section 210, and humidification section (humidifier) 220. It is to be noted that the sheet conveyed in sheet humidification apparatus 200 is conveyed toward after-treatment apparatus 300 provided at a position succeeding sheet humidification apparatus 200. It is to be noted that, while sheet humidification apparatus 200 is disposed on the downstream side of image forming apparatus 100, sheet humidification apparatus 200 may be disposed inside image forming apparatus 100, or may be disposed inside after-treatment apparatus 300 described later.

Here, control section 201 controls each section of sheet humidification apparatus 200. Communication section 202 communicates with other apparatuses connected thereto. Conveyance section 210 conveys a sheet from image forming apparatus 100 on which an image has been formed via path 210*a* or humidification path 210*b* at a predetermined speed. In accordance with the position of the sheet conveyed along the humidification path, humidification section 220 under the control of control section 201 humidifies a first region on the front end side of the sheet in the conveyance direction with a first humidification amount, and humidifies a second region of the sheet other than the first region with a second humidification amount larger than the first humidification amount.

After-treatment apparatus 300 is provided at a position succeeding image forming apparatus 100 and sheet humidification apparatus 200 in the sheet conveyance direction. After-treatment apparatus 300 includes control section 301, communication section 302, post-processing section 320, and sheet ejection section 390. Here, control section 301 controls each section of after-treatment apparatus 300. Communication section 302 communicates with other apparatuses connected thereto. Post-processing section 320 performs various kinds of post-processing on the sheet. Sheet ejection section 390 outputs the sheet to a predetermined outlet.

It is to be noted that the above-mentioned functions, components and connections of sheet feeding apparatus 50, image forming apparatus 100, sheet humidification apparatus 200, after-treatment apparatus 300 (see FIGS. 1 and 2) are merely an example, and are not limited thereto.

Here, humidification section 220, which is a principal part of sheet humidification apparatus 200, has an exemplary configuration illustrated in FIG. 3. In this exemplary configuration, the sheet is humidified while being conveyed downward in a vertical direction along humidification path 210*b* at first, and then conveyed upward.

Humidification unit (sandwiching adjuster) 221 of humidification section 220 is disposed in such a manner as to humidify the sheet from both sides of humidification path 210*b*.

Humidification unit 221 includes first humidification unit 221*a* and second humidification unit 221*b* which are configured to adjust the pressure and the distance at the time of sandwiching the sheet, and serve as a sandwiching adjustment section.

First humidification unit 221*a* may comprise water tank 222*a* serving as a water supply section for supplying water for humidification, and water W is stored in water tank 222*a*. In addition, second humidification unit 221*b* may comprise water tank 222*b* serving as a water supply section for supplying water for humidification, and water W is stored in water tank 222*b*. It is to be noted that, for water W stored in water tanks 222*a* and 222*b*, other water tanks and pumps which are not illustrated in the drawing are provided.

In first humidification unit 221*a*, first water supply roller 223*a* rotates clockwise and sucks up the water from water tank 222*a* with a groove provided on the surface or a porous material on the surface. In addition, restriction roller 224*a* that makes contact with first water supply roller 223*a* rotates counterclockwise, and scrapes the water from the surface of first water supply roller 223*a*. In addition, first humidification roller 225*a* that makes contact with first water supply roller 223*a* and can make contact with second humidification roller 225*b* with humidification path 210*b* therebetween conveys the sheet while rotating counterclockwise and humidifying the sheet. It is to be noted that, as an exemplary case, the central shaft of restriction roller 224*a* is driven into rotation by a motor not illustrated in the drawing or the like, whereby water supply roller 223*a* that makes contact with restriction roller 224*a* is driven into rotation, and moreover, humidification roller 225*a* that makes contact with water supply roller 223*a* is driven into rotation.

In second humidification unit 221*b*, second water supply roller 223*b* rotates counterclockwise, and sucks up the water from water tank 222*b* with a groove provided on the surface or a porous material on the surface. In addition, restriction roller 224*b* that makes contact with second water supply roller 223*b* rotates clockwise, and scrapes the water from the surface of second water supply roller 223*a*. In addition, second humidification roller 225*b* that makes contact with second water supply roller 223*b* and can make contact with first humidification roller 225*a* with humidification path 210*b* therebetween conveys the sheet while rotating clockwise and humidifying the sheet. It is to be noted that, as an exemplary case, the central shaft of restriction roller 224*b* is driven into rotation by a motor not illustrated in the drawing or the like, whereby water supply roller 223*b* that makes contact with restriction roller 224*b* is driven into rotation, and moreover humidification roller 225*b* that makes contact with water supply roller 223*b* is driven into rotation.

It is to be noted that, with the operations of first humidification unit 221*a* and second humidification unit 221*b*, the contacting state (sandwiching pressure, sandwiching distance, and contact area) of first humidification roller 225*a* and second humidification roller 225*b* with the sheet is controlled, the first region on the front end side of the sheet in the conveyance direction is humidified with the first humidification amount, and the second region of the sheet other than the first region is humidified with the second humidification amount larger than the first humidification amount.

Here, when the sandwiching pressure is increased, or when the sandwiching distance is reduced in first humidification roller 225*a* and second humidification roller 225*b*, the contacting area therebetween is increased, and the humidification amount on the sheet is increased. Conversely, when the sandwiching pressure is reduced, or when the sandwiching distance is not reduced in first humidification roller 225*a* and second humidification roller 225*b*, the contacting area therebetween is reduced, and the humidification amount on the sheet is reduced.

It is to be noted that, the above-mentioned operations for adjusting the humidification amount by first humidification roller 225*a* and second humidification roller 225*b* in humidification unit 221*a* and second humidification unit 221*b* are achieved with an adjustment mechanism using various kinds of units such as a cam, a ball screw feed mechanism, an actuator, and a linear motor.

In addition, the above-described adjustment of the humidification amount can also be achieved based on the contacting state of restriction roller 224*a* (224*b*) and water supply roller 223*a* (223*b*), or the contacting state of humidification roller 225*a* (225*b*) and water supply roller 223*a* (223*b*).

[Operations]

In the following, operations will be described with reference to the flowchart of FIG. 4 and subsequent state explanatory diagrams.

It is to be noted that, in the present embodiment, the first region on the front end side of the sheet in the conveyance direction is humidified with the first humidification amount, and the second region of the sheet other than the first region is humidified with the second humidification amount larger than the first humidification amount.

Here, the second humidification amount is a humidification amount required to prevent curling and waviness of the sheet and ensure flatness of the sheet by supplying the water to the sheet by an amount reduced by the thermal fixation of fixing section 160. It is to be noted that the second humidification amount is determined by a known way on the basis of the configuration of the image forming apparatus, the operation state, the characteristics of the sheet and the like. In addition, the first humidification amount is a humidification amount for preventing the leading end of the sheet from winding around humidification rollers 225*a* and 225*b*, and is smaller than the second humidification amount.

Figure 4:
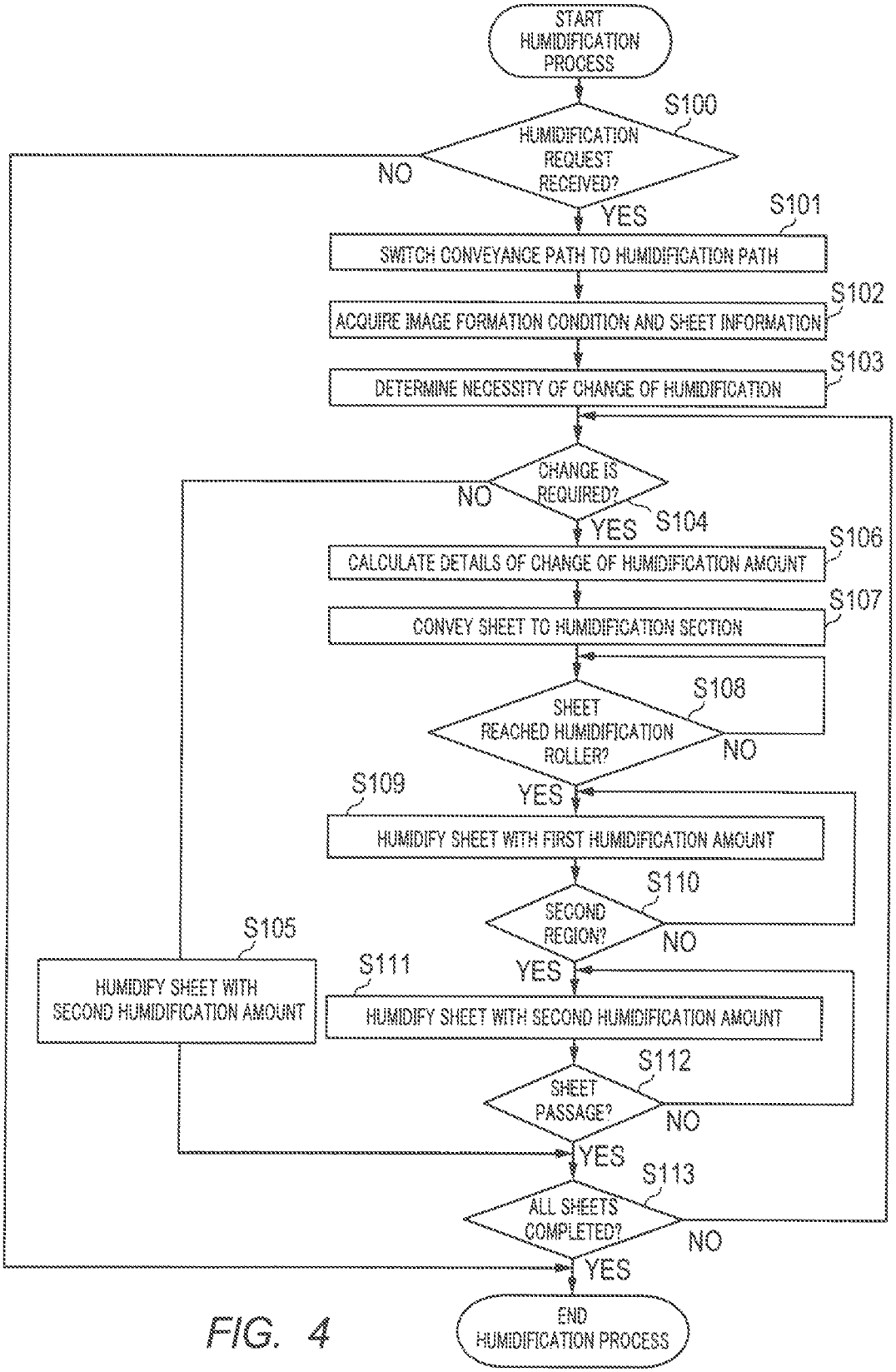
FIG. 4 is a flowchart of an operation of image formation of one or more embodiments of the present invention.

When image formation is started in image forming apparatus 100, and a sheet humidification process is included in the image formation, control section 201 receives a humidification request from control section 101 via communication section 102 to communication section 202 (YES at step S100 in FIG. 4).

It is to be noted that, when image formation is started in image forming apparatus 100 and a sheet humidification process is not included in the image formation, control section 201 keeps the conveyance path of conveyance section 210 at path 210*a* which is the initial position, and terminates the humidification process (NO at step S100, END in FIG. 4).

When receiving the humidification request (YES at step S100 in FIG. 4), control section 201 operates to switch the conveyance path of conveyance section 210 from path 210*a* which is the initial position to humidification path 210*b*, and convey the sheet from image forming apparatus 100 to humidification section 220 (at step S101 in FIG. 4).

In addition, for the sheet which is a subject of the received humidification request, control section 201 acquires from control section 101 the image formation condition of the image formation executed in image forming apparatus 100, the sheet information of the sheet used for the image formation and the like (at step S102 in FIG. 4). When there is other information which can affect the sheet conveyance, control section 201 may acquire the information from control section 101.

Here, as the image formation condition, at least information on the charging voltage, information on the fixing temperature, information on the dot ratio in the image are acquired. Here, when the charging voltage is high, the sheet is in a charged state and the sheet is easily curled. In addition, when the fixing temperature is high, the amount of the water of the sheet is small, and the sheet is easily curled. In addition, when the dot ratio is small, the amount of the water held in the sheet is large, and the sheet after the humidification easily winds around the roller.

In addition, as the sheet information, at least information on the sheet type (plain paper, thick paper, thin paper, coated paper or the like) is acquired. Here, when thin paper is used, the sheet after the humidification easily winds around the roller in comparison with plain paper or thick paper. In addition, when coated paper is used, water is held on the sheet, and the sheet after the humidification easily winds around the roller.

Then, control section 201 refers to the image formation condition and the sheet information acquired in the above-mentioned manner to determine whether the humidification amount is required to be changed (at step S103 in FIG. 4).

Control section 201 refers to the diameters of humidification rollers 225*a* and 225*b*, the above-described image formation condition, and the above-described sheet type, and when the sheet is in the state where the sheet easily winds around humidification rollers 225*a* and 225*b* when the sheet is humidified at the second humidification amount, control section 201 determines that the humidification amount is required to be changed.

Here, whether the sheet is in the easily winding state can be determined with reference to the following parameters. Control section 201 acquires the information required here (parameters and the state) from control section 101.

For example, the parameters and the values thereof which correspond to the easily winding state are: humidification roller diameter: large, sheet type: thin paper or coated paper, charging voltage: high, image density (toner amount): low density, and fixing temperature: high. In addition, the parameters and the values thereof which do not correspond to the easily winding state are: humidification roller diameter: small, sheet type: plain paper or thick paper, charging voltage: low, image density (toner amount): high density, and fixing temperature: low.

To be more specific, with reference to a table shown in FIG. 5 of parameters and parameter values of ease of winding, the states are quantified in such a manner that the states where winding is easily caused and not easily caused are respectively represented by +1 and −1 point, and then, the total point is calculated by adding up the parameters.

Then, in the case where the threshold for determining whether the sheet is in the easily winding state is set to 1 point as the determination criteria for example, it is determined that the sheet is not in the easily winding state when the total point is 0 point or smaller, and it is determined that the sheet is in the easily winding state when the total point is 1 point or greater.

That is, in this case, whether the sheet is in the easily winding state can be determined by comparing the total point calculated by quantifying (−1 point/+1 point) the parameter values (large/small, high/low and the like), with a threshold (for example, 1 point).

It is to be noted that the parameters (humidification roller diameter, sheet type, charging voltage, image density, and fixing temperature) and their points (+1 point, −1 point), the determination criteria (0 point or smaller, 1 point or greater) and the like are merely examples, and may be appropriately modified.

For example, it is also possible to set a plurality of states in multiple levels of 0 point to 10 points in each parameter, and set the above-described threshold to 5 points or 6 points such that the ease of winding can be further comprehensively determined by comparing the sum of the points of the parameters with the threshold.

When it is determined that the humidified sheet is not in the state where the sheet easily winds around humidification rollers 225*a* and 225*b* in the above-mentioned determination, control section 201 determines that the humidification amount is not required to be changed (NO at step S104 in FIG. 4). In this case, a humidification process with the known second humidification amount required to prevent curling and waviness of the sheet and ensure flatness of the sheet is executed (at step S105 in FIG. 4).

When it is determined in the above-mentioned determination that the humidified sheet is in the state where the sheet easily winds around humidification rollers 225*a* and 225*b*, control section 201 determines that the humidification amount is required to be changed (YES at step S104 in FIG. 4).

When it is determined that the humidification amount is required to be changed, control section 201 calculates the details of the change of the humidification amount (at step S106 in FIG. 4). It is to be noted that, when it is determined that the humidification amount is required to be changed, control section 201 may refer to the total points of the case where the states of the parameters of FIG. 5 are quantified to calculate the details of the change of the humidification amount. Control section 201 acquires the information required here from control section 101. It is to be noted that the calculation of the details of the change of the humidification amount (at step S106 in FIG. 4) and the above-described determination of the necessity of change of the humidification amount (at step S103 in FIG. 4) may be performed simultaneously or in parallel.

Here, the details of the change of the humidification amount are as follows, for example.

(1) During conveyance, the first region on the front end side of the sheet in the conveyance direction is humidified with the first humidification amount, and the second region of the sheet other than the first region is humidified with the second humidification amount larger than the first humidification amount.

(2) In (1), when the sheet is conveyed with humidification rollers 225*a* and 225*b* in a sandwiching manner, the contacting state of humidification rollers 225*a* and 225*b* with respect to the sheet is changed to thereby switch between the first humidification amount and the second humidification amount.

In addition, in (1), when the sheet is conveyed with humidification rollers 225*a* and 225*b* in a sandwiching manner, the state of water supply from water supply rollers 223*a* and 223*b* to humidification rollers 225*a* and 225*b* is changed and the contacting state of humidification rollers 225*a* and 225*b* with respect to the sheet is changed to thereby switch between the first humidification amount and the second humidification amount.

(3) In (2), the sheet sandwiching pressure of humidification rollers 225*a* and 225*b*, or, the sandwiching distance of humidification rollers 225*a* and 225*b* is adjusted to thereby change the contacting state, and switch between the first humidification amount and the second humidification amount.

(4) In (3), the sheet sandwiching pressure of humidification rollers 225*a* and 225*b*, or, the sandwiching distance of humidification rollers 225*a* and 225*b* is adjusted to thereby change the contact area of humidification roller 225*a* and 225*b* on the sheet, and switch between the first humidification amount and the second humidification amount.

(5) In (2) to (4), the timing of switching from the first humidification amount to the second humidification amount is controlled with reference to the diameter of the humidification roller.

(6) In (2) to (5), the first humidification amount is determined with reference to the diameter of the humidification roller.

(7) In (1) to (6), the timing of switching from the first humidification amount to the second humidification amount is controlled with reference to the second humidification amount.

(8) In (1) to (7), the timing of switching from the first humidification amount to the second humidification amount is controlled with reference to the type of the sheet.

(9) In (1) to (8), the timing of switching from the first humidification amount to the second humidification amount is controlled with reference to the image formation condition in the case where an image has been formed on the sheet.

That is, control section 201 calculates the details of the change of the humidification amount such that, as the ease of the sheet winding around humidification rollers 225*a* and 225*b* increases, the sandwiching pressure of humidification rollers 225*a* and 225*b* is reduced to reduce the first humidification amount, or, the first region which is humidified with the first humidification amount smaller than the second humidification amount is expanded.

For example, the ease of sheet winding increases in proportion to diameter r of humidification rollers 225*a* and 225*b*. In view of this, control section 201 expands the first region on the sheet front end side in proportion to roller diameter r (delays the timing of switching from the first humidification amount to the second humidification amount). In this case, it suffices that the length of the first region in the conveyance direction according to the roller diameter r is determined by preliminarily calculating by experiment the relationship, which does not cause winding, between roller diameter r and the length of the first region on the sheet front end side in the conveyance direction. Alternatively, control section 201 adjusts the first humidification amount by determining sandwiching pressure P between humidification rollers 225*a* and 225*b* such that, in inverse proportion to roller diameter r, sandwiching pressure P decreases as roller diameter r increases. In this case, it suffices to determine sandwiching pressure P according to the roller diameter r by preliminarily calculating by experiment the relationship, which does not cause winding, between roller diameter r and sandwiching pressure P.

In addition, the ease of sheet winding increases in inverse proportion to sheet thickness d. In view of this, control section 201 expands the first region in inverse proportion to sheet thickness d (delays the timing of switching from the first humidification amount to the second humidification amount). In this case, it suffices to determine the length of the first region in the conveyance direction according to sheet thickness d by preliminarily calculating by experiment the relationship, which does not cause winding, between sheet thickness d and the length of the first region on the sheet front end side in the conveyance direction. Alternatively, control section 201 determines sandwiching pressure P between humidification rollers 225*a* and 225*b* in proportion to sheet thickness d to determine the first humidification amount. In this case, it suffices to determine sandwiching pressure P according to sheet thickness d by preliminarily calculating by experiment the relationship, which does not cause winding, between sheet thickness d and sandwiching pressure P.

In addition, the ease of sheet winding increases in proportion to the smoothness resulting from a sheet surface treatment under the influence of the water of the sheet surface. In view of this, control section 201 expands the first region in proportion to the sheet smoothness (delays the timing of switching from the first humidification amount to the second humidification amount). In this case, it suffices to determine the length of the first region in the conveyance direction according to the smoothness of the sheet surface by preliminarily calculating by experiment the relationship, which does not cause winding, between the smoothness of the sheet surface and the length of the first region on the sheet front end side in the conveyance direction. Alternatively, control section 201 determines the first humidification amount by determining sandwiching pressure P between humidification rollers 225*a* and 225*b* such that sandwiching pressure P is reduced when the smoothness is high in inverse proportion to the sheet smoothness. In this case, it suffices to determine sandwiching pressure P according to the smoothness of the sheet surface by preliminarily calculating by experiment the relationship, which does not cause winding, between the smoothness of the sheet surface and sandwiching pressure P.

Likewise, the ease of sheet winding increases in proportion to the charging voltage and the fixing temperature. In view of this, control section 201 expands the first region on the sheet front end side in proportion to the charging voltage and the fixing temperature (delays the timing of switching from the first humidification amount to the second humidification amount). In this case, it suffices to determine the length of the first region in the conveyance direction according to the charging voltage and the fixing temperature by preliminarily calculating by experiment the relationship, which does not cause winding, between the charging voltage or the fixing temperature and the length of the first region on the sheet front end side in the conveyance direction. Alternatively, control section 201 determines sandwiching pressure P between humidification rollers 225*a* and 225*b* in inverse proportion to the charging voltage and the fixing temperature to adjust the first humidification amount. In this case, it suffices to determine sandwiching pressure P according to the charging voltage and the fixing temperature by preliminarily calculating by experiment the relationship, which does not cause winding, between the charging voltage or the fixing temperature and sandwiching pressure P.

Likewise, the ease of sheet winding increases in inverse proportion to the image density. In view of this, control section 201 expands the first region on the sheet front end side in inverse proportion to the image density (delays the timing of switching from the first humidification amount to the second humidification amount). In this case, it suffices to determine the length of the first region in the conveyance direction according to the image density by preliminarily calculating by experiment the relationship, which does not cause winding, between the image density and the length of the first region on the sheet front end side in the conveyance direction. Alternatively, control section 201 determines sandwiching pressure P between humidification rollers 225*a* and 225*b* in proportion to the image density to adjust the first humidification amount. In this case, it suffices to determine sandwiching pressure P according to the image density by preliminarily calculating by experiment the relationship, which does not cause winding, of the image density. It is to be noted that, when attention is paid to the image density, it suffices to pay attention to the image density of the front end side of the sheet in the conveyance direction in consideration of the sheet winding.

In addition, the second humidification amount itself is also a cause of increase of the ease of sheet winding around humidification rollers 225*a* and 225*b*. Accordingly, control section 201 operates such that the first region on the sheet front end side is expanded in proportion to the second humidification amount (the timing of switching from the first humidification amount to the second humidification amount is delayed). In this case, it suffices to determine the length of the first region in the conveyance direction according to the second humidification amount by preliminarily calculating by experiment the relationship, which does not cause winding, between the second humidification amount and the length of the first region on the sheet front end side in the conveyance direction.

Figure 8A:
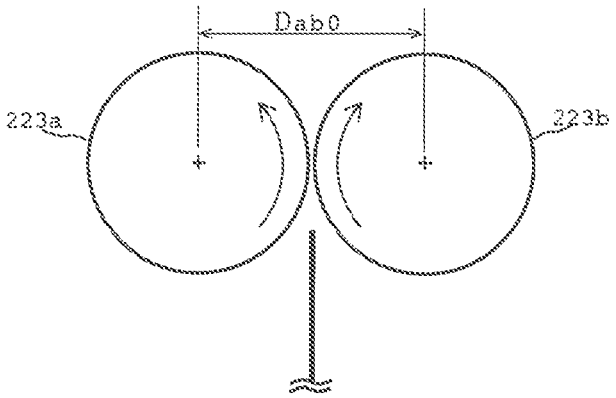
FIGS. 8A to 8D are explanatory diagrams illustrating an operation state of the sheet humidification apparatus of one or more embodiments of the present invention.

Then, control section 201 conveys the sheet to humidification section 220 (at step S107 in FIG. 4), and whether the front end of the sheet has been reached the sandwiching position of a pair of humidification rollers 225*a* and 225*b* is detected with detection section (detect sensor) 230 provided with a sensor (YES at step S108 in FIG. 4 and the state of FIG. 8A).

It is to be noted that, in this case, the sensor is not required to be provided at the above-described sandwiching position as long as whether the sheet reaches the sandwiching position can be determined based on the detection result at another position, the sheet conveyance speed and the conveyance distance. Accordingly, in the case where the sheet is conveyed at a constant speed, it is possible to use a sensor in the proximity of the entrance of sheet humidification apparatus 200.

Figure 8B:
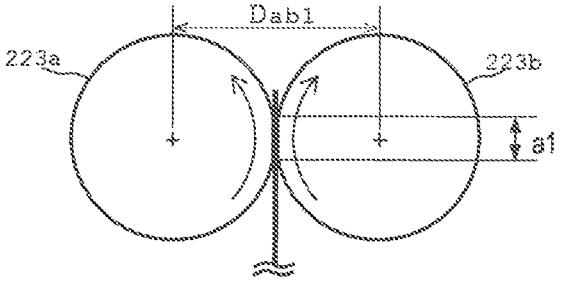

At the time point when the front end of the sheet reaches the sandwiching position of the pair of humidification rollers 225*a* and 225*b* (YES at step S108 in FIG. 4), control section 201 operates such that the sheet is conveyed while being humidified and sandwiched by humidification rollers 225*a* and 225*b* with first sandwiching pressure P1 (at step S109 in FIG. 4, P1 in FIG. 6, and the state of FIG. 8B). It is to be noted that the control of sandwiching pressure P1 by humidification rollers 225*a* and 225*b* is achieved with an adjustment mechanism provided in first humidification unit 221*a* and second humidification unit 221*b*. The adjustment mechanism uses various kinds of units such as a cam, a ball screw feed mechanism, an actuator, and a linear motor.

It is to be noted that, with sandwiching pressure P1 of humidification rollers 225*a* and 225*b*, distance Dab of humidification rollers 225*a* and 225*b* is changed from Dab0 to Dab1 (see FIG. 7, FIG. 8A, and FIG. 8B). Here, when the radius of humidification roller 225*a* is represented by R1 and the radius of humidification roller 225*b* is represented by R2, Dab0 can be expressed as Dab0=R1+R2, or Dab0=R1+R2+d. Thus, Dab1 can be expressed as Dab<R1+R2+d.

Here, Dab1<R1+R2+d as an expression of the state of FIG. 8B means a state where humidification rollers 225*a* and 225*b* sandwiching the sheet are deformed. It is to be noted that, in this case, the contact length of humidification roller 225*a*, humidification roller 225*b* and the sheet in the conveyance direction is a1.

Figure 9A:
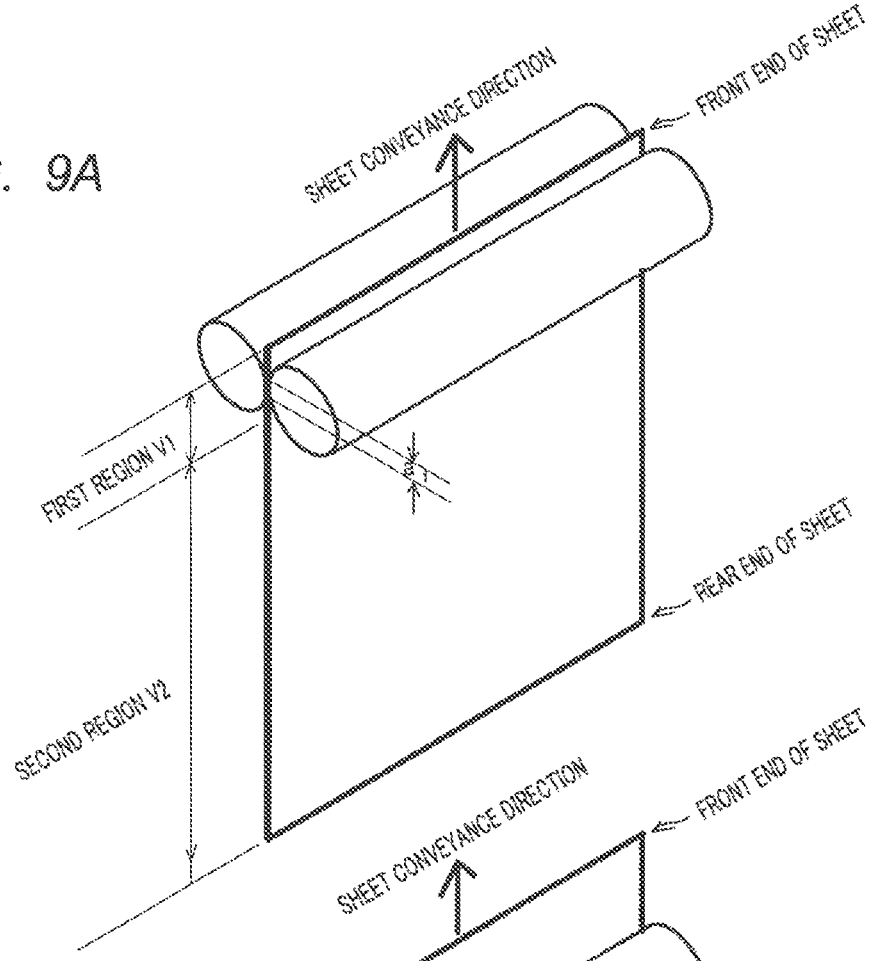
FIGS. 9A and 9B are explanatory diagrams illustrating an operation state of the sheet humidification apparatus of one or more embodiments of the present invention.
Figure 9B:
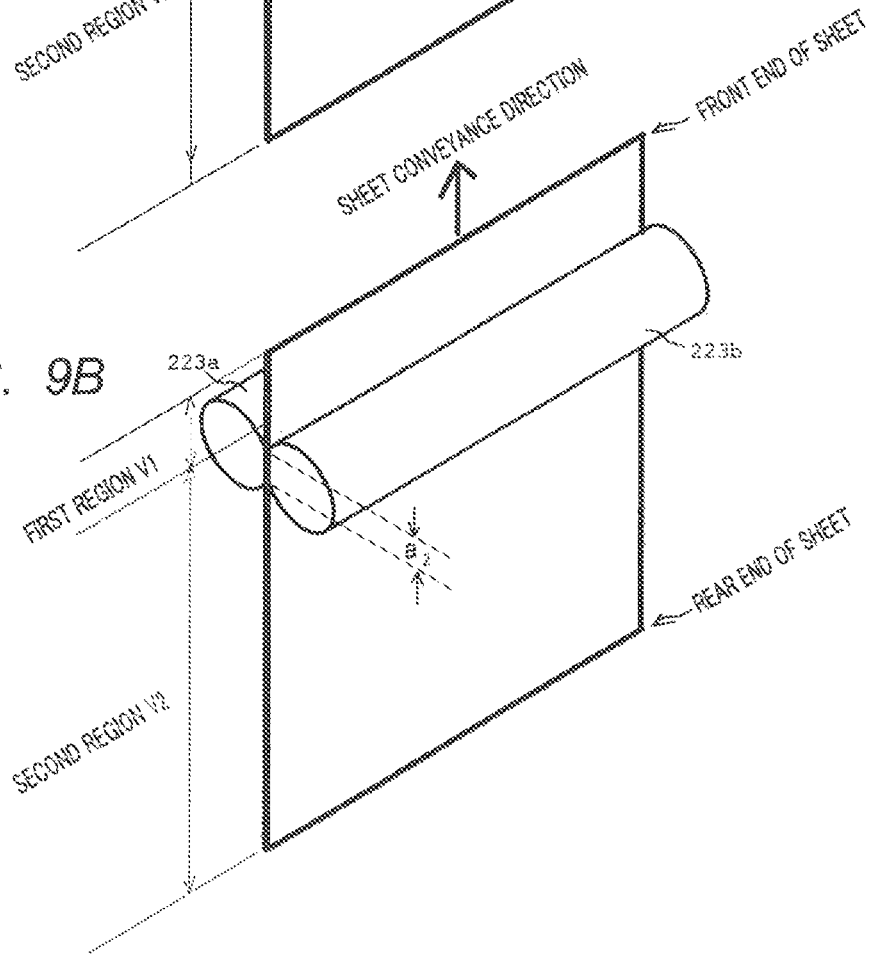

It is to be noted that a1·b, which is the product of sheet width b in a perpendicular direction as seen in FIG. 8B and contact length a1 in the conveyance direction, corresponds to the contacting state of humidification rollers 225*a* and 225*b* with respect to the sheet in first region V1. In addition, this state is illustrated in a perspective view of FIG. 9A. That is, in first region V1, the contact area of the sheet and humidification rollers 225*a* and 225*b* is reduced in comparison with second region V2 described later, and thus humidification with the first humidification amount smaller than the second humidification amount is achieved.

In addition, control section 201 continuously performs counting from the time point when the front end of the sheet has reached the position between humidification rollers 225*a* and 225*b* in the above-mentioned manner, and determines whether the position of the sheet sandwiched between humidification rollers 225*a* and 225*b* has reached second region V2 subsequent to first region V1 with reference to the sheet conveyance speed (at step S110 in FIG. 4).

Figure 8C:
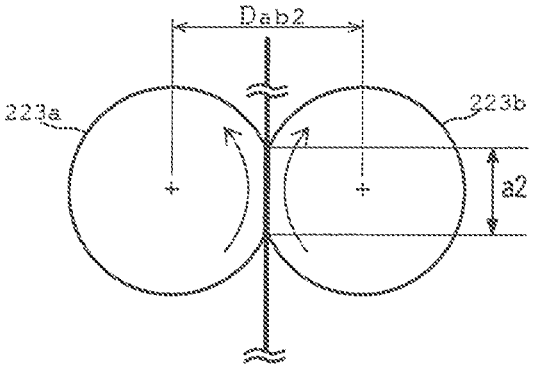

At the time point when the rear end of sheet first region V1 (front end of sheet second region V2) reaches the sandwiching position of the pair of humidification rollers 225*a* and 225*b* (YES at step S110 in FIG. 4), control section 201 operates such that the sheet is conveyed while being humidified and sandwiched by humidification rollers 225*a* and 225*b* with second sandwiching pressure P2 (at step S111 in FIG. 4, P2 in FIG. 6, and the state of FIG. 8C).

It is to be noted that second sandwiching pressure P2 is greater than the above-described first sandwiching pressure P1, and is intended for achieving the second humidification amount larger than the first humidification amount. It is to be noted that, as described above, the second humidification amount is a known humidification amount required to prevent curling and waviness of the sheet and ensure flatness of the sheet.

In addition, first sandwiching pressure P1 and second sandwiching pressure P2 of humidification rollers 225*a* and 225*b* is controlled with an adjustment mechanism provided in first humidification unit 221*a* and second humidification unit 221*b*. The adjustment mechanism uses various kinds of units such as a cam, a ball screw feed mechanism, an actuator, and a linear motor.

It is to be noted that, with sandwiching pressure P2 of humidification rollers 225*a* and 225*b*, distance Dab of humidification rollers 225*a* and 225*b* is changed from Dab1 to Dab2 (see FIG. 7, FIG. 8B, FIG. 8C and FIG. 9B). Here, when the radius of humidification roller 225*a* is represented by R1 and the radius of humidification roller 225*b* is represented by R2, Dab2 can be expressed as Dab2<Dab1.

In addition, here, Dab2<Dab1 as an expression of the state of FIG. 8C means a state where humidification rollers 225*a* and 225*b* sandwiching the sheet is further deformed in comparison with Dab1. It is to be noted that, in this case, the contact length of humidification roller 225*a*, humidification roller 225*b* and the sheet in the conveyance direction is a2 which is greater than a1. This state is illustrated in a perspective view of FIG. 9B.

It is to be noted that a2·b, which is the product of sheet width b in a perpendicular direction as seen in FIG. 8C and contact length a2 in the conveyance direction, corresponds to the contacting state of humidification rollers 225*a* and 225*b* with respect to the sheet in second region V2. That is, in second region V2, the contact area of the sheet and humidification rollers 225*a* and 225*b* is increased in comparison with second region V1, and thus the amount of humidification can be increased.

Figure 8D:
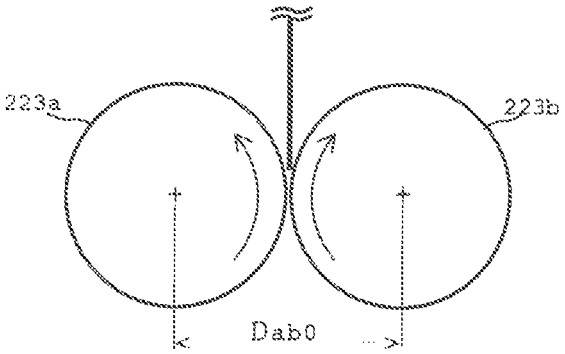

At the time point when the rear end of the sheet reaches the sandwiching position of the pair of humidification rollers 225*a* and 225*b* (YES at step S112 in FIG. 4) after the above-mentioned humidification with the second humidification amount is executed in second region V2 (at step S111 in FIG. 4), sandwiching pressure P2 of humidification rollers 225*a* and 225*b* is released (the rear end of the sheet of FIG. 6 and of FIG. 7 and the state of FIG. 8D).

Then, control section 201 controls each section such that the above-mentioned humidification process is executed on all of the other sheets which are subjects of the requested image formation (at steps S104 to S112 in FIG. 4 in FIG. 4). Then, at the time point when the all sheets have been subjected to the humidification process (YES at step S113 in FIG. 4), control section 201 terminates the humidification process (End in FIG. 4).

As described, by adjusting the sandwiching pressure or the sandwiching distance of humidification rollers 225*a* and 225*b* and by changing the contact area of the sheet and humidification rollers 225*a* and 225*b* in accordance with the position of the sheet, the first region on the front end side of the sheet in the conveyance direction is humidified with the first humidification amount, and the second region of the sheet other than the first region is humidified with the second humidification amount larger than the first humidification amount. In this manner, it is possible to reduce the situation where the front end region of the sheet easily winds around humidification rollers 225*a* and 225*b* under the influence of the water of the surface of the humidified sheet, and thus it is possible to achieve humidification of the sheet without negatively affecting the sheet conveyance.

[Second Example]

Figure 10:
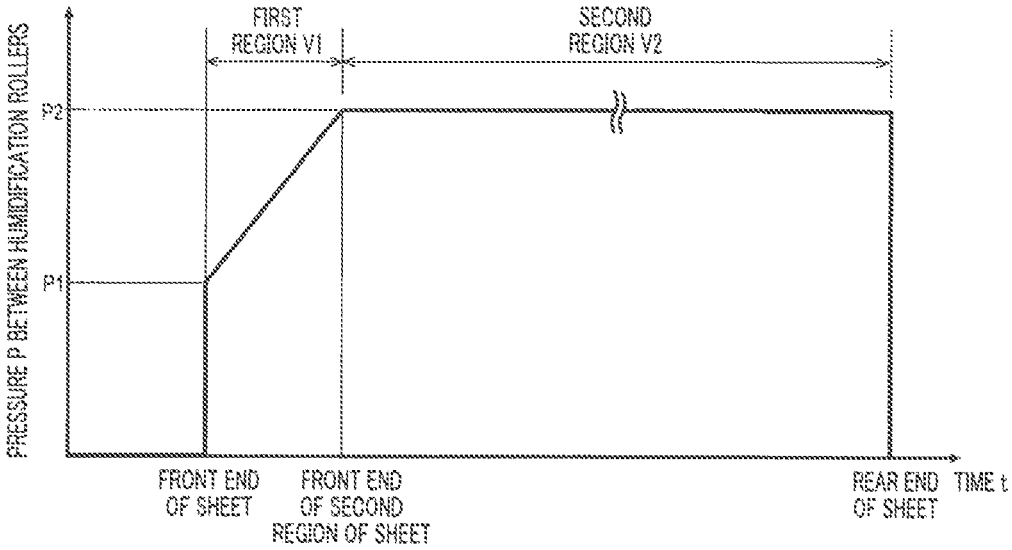
FIG. 10 is an explanatory diagram illustrating an operation state of a sheet humidification apparatus of one or more embodiments of the present invention.
Figure 11:
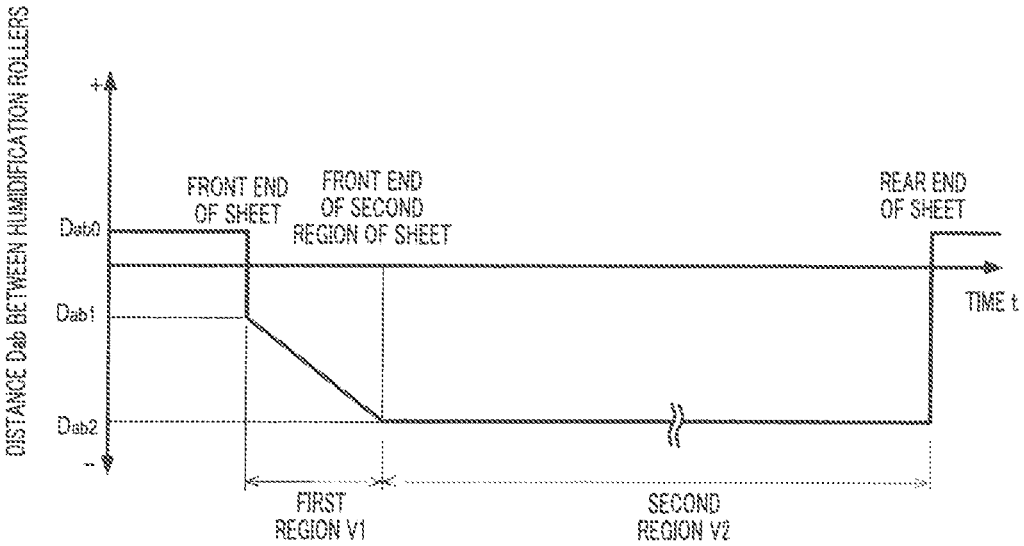
FIG. 11 is an explanatory diagram illustrating an operation state of a sheet humidification apparatus of one or more embodiments of the present invention.

FIG. 10 and FIG. 11 are explanatory diagrams of a principal configuration according to one or more embodiments of a second example of the invention. FIG. 10 corresponds to the sandwiching pressure of the humidification roller of FIG. 6 according to the above-stated embodiments (a first example), and FIG. 11 corresponds to the distance of the humidification roller of FIG. 7 of the embodiments of the first example.

In the embodiments of the first example, in first region V1 of the front end side of the sheet, the sheet is constantly conveyed while being humidified and sandwiched by humidification rollers 225*a* and 225*b* at first sandwiching pressure P1. Here, since first sandwiching pressure P1 is smaller than second sandwiching pressure P2, the first humidification amount is smaller than the second humidification amount. In addition, in the above-described embodiment, distance Dab of humidification rollers 225*a* and 225*b* is constantly maintained at Dab1 with sandwiching pressure P1 of humidification rollers 225*a* and 225*b* in first region V1 (see first region V1 of FIG. 7).

In one or more embodiments of the second example, in first region V1, the sheet winding is most easily caused at the front end of the sheet, and the ease of the sheet winding decreases toward second region V2. That is, when the winding is not caused at the front end of the sheet, the possibility of the winding in the subsequent region is small.

In view of this, at the front end of the sheet, the sandwiching pressure and the distance of humidification rollers 225*a* and 225*b* are respectively set to P1 and Dab1 to surely prevent the winding around sheet humidification rollers 225*a* and 225*b*.

Then, as the sandwiching position of the sheet of humidification rollers 225*a* and 225*b* is changed toward second region V2 during the sheet conveyance, the sandwiching pressure is smoothly changed from P1 to P2 without being fixed at sandwiching pressure P1. Likewise, the sandwiching distance of humidification rollers 225*a* and 225*b* is smoothly changed from Dab1 to Dab2 without constantly maintaining the sandwiching distance of humidification rollers 225*a* and 225*b* at Dab1 (see FIGS. 10 and 11).

In this case, in first region V1, the first humidification amount smaller than the second humidification amount is gradually changed toward the second humidification amount within a range of smaller than the second humidification amount.

Also in the above-mentioned configuration of the embodiments of the second example, the first region on the front end side of the sheet in the conveyance direction is humidified with the first humidification amount, and the second region of the sheet other than the first region is humidified with the second humidification amount larger than the first humidification amount. In this manner, it is possible to reduce the situation where the front end region of the sheet easily winds around humidification rollers 225*a* and 225*b* under the influence of the water of the surface of the humidified sheet, and thus it is possible to achieve humidification of the sheet without negatively affecting the sheet conveyance.

In addition, with the configuration of the embodiments of the second example, abrupt change of the sandwiching pressure in the middle of the sheet is not caused, and therefore damaging of the sheet can be reduced.

[Third Example]

In the embodiments of the first and second examples, the relationship "first humidification amount <second humidification amount" is described.

Figure 12A:
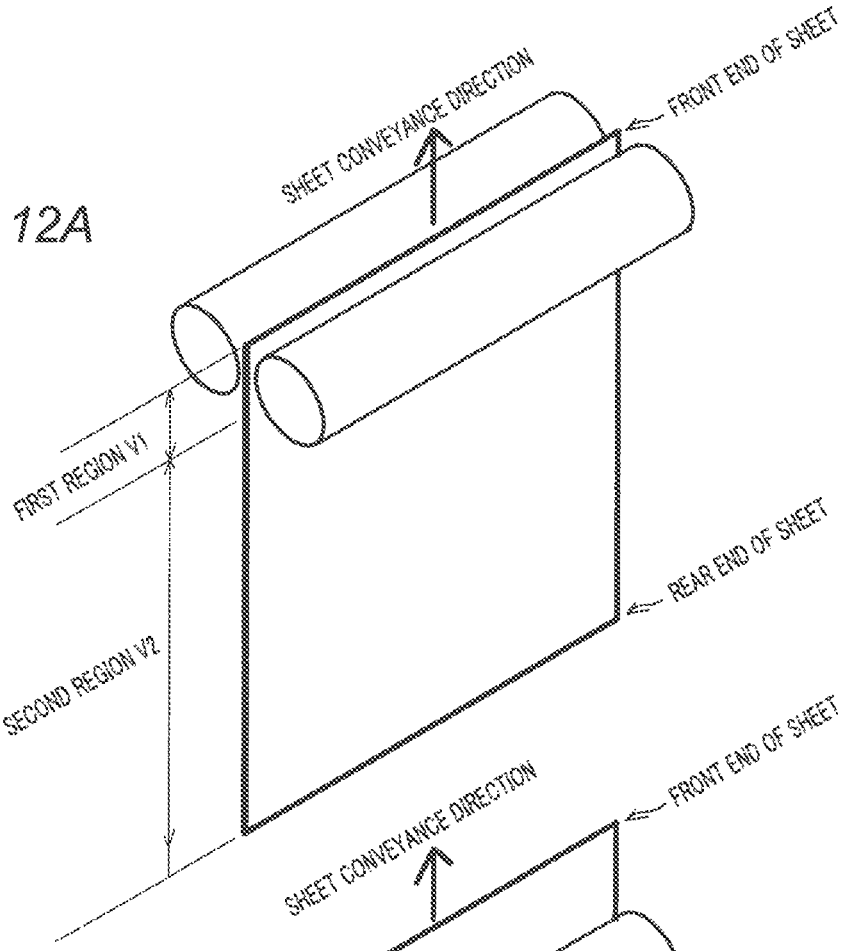
FIGS. 12A and 12B are explanatory diagrams illustrating an operation state of a sheet humidification apparatus of one or more embodiments of the present invention.
Figure 12B:
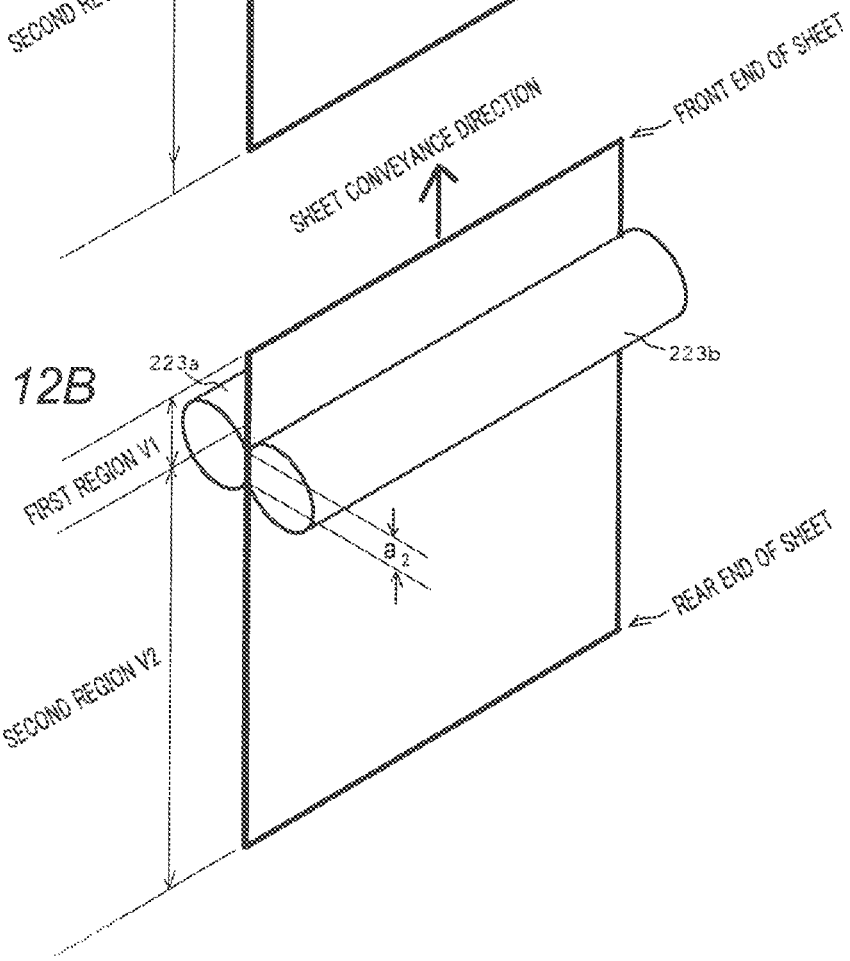

In one or more embodiments of a third example as a modification, it is possible to adopt a configuration in which humidification rollers 225*a* and 225*b* are not brought into contact with the sheet in first region V1 (see FIG. 12A), and the sheet is sandwiched between humidification rollers 225*a* and 225*b* in second region V2 to achieve the second humidification amount (see FIG. 12B). In this case, since the sheet is not humidified in first region V1, it is possible to surely prevent the sheet from winding around humidification rollers 225*a* and 225*b*. In one or more embodiments of the third example, the first humidification amount is zero, and therefore the size of first region can be reduced in comparison with the embodiments of the first and second examples.

[Other Examples]

While sheet humidification apparatus 200 is connected at a position on the downstream side of the image forming apparatus in the above-mentioned embodiments, the above-mentioned embodiments are not limited to this, and sheet humidification apparatus 200 may be disposed in image forming apparatus 100, or in after-treatment apparatus 300. Alternatively, sheet humidification apparatus 200 may be incorporated in an intermediate reversing apparatus not illustrated in the drawing or the like.

In addition, while the humidification amount is controlled based on the sandwiching pressure and the distance of humidification rollers 225*a* and 225*b* in the above-mentioned embodiments, the present invention is not limited to this, and the humidification amount may be controlled based on water supply to humidification rollers 225*a* and 225*b*.

For example, the first humidification amount smaller than the second humidification amount may be achieved by reducing the contact pressure of water supply rollers 223*a* and 223*b* and humidification rollers 225*a* and 225*b* or by increasing the distance thereof in comparison with preliminarily set preset value of the second humidification amount.

In addition, the first humidification amount smaller than the second humidification amount may be achieved by increasing the contact pressure of water supply rollers 223*a* and 223*b* and humidification rollers 225*a* and 225*b* or by reducing the distance thereof in comparison with preliminarily set preset value of the second humidification amount.

It is to be noted that, since a certain period until the control of the humidification amount based on the control of the water supply acts on the humidification roller is required, it is required to control the humidification amount based on the water supply by preliminarily estimating the period of time until the sheet reaches humidification rollers 225*a* and 225*b*.

In addition, while humidification rollers 225*a* and 225*b* are used to humidify the sheet in the above-mentioned embodiments, a water vapor spraying unit may be used to control the first humidification amount and the second humidification amount. In this case, reduction of sheet winding around the conveyance roller immediately after humidification using the water vapor spraying can be achieved.

[Effect]

The following effects can be achieved with the sheet humidification apparatus and the humidification control method reflecting the above-mentioned embodiments.

(1) When a sheet is humidified to ensure flatness by reducing the curl, waviness and the like of a sheet output from a thermal fixation apparatus, the first region on the front end side of the sheet in the conveyance direction is humidified with the first humidification amount, and the second region of the sheet other than the first region is humidified with the second humidification amount larger than the first humidification amount in accordance with the detected position of the sheet which is being conveyed. Consequently, it is possible to reduce the situation where the front end region of the sheet easily winds around the roller under the influence of the water of the surface of the humidified sheet. Thus, it is possible to achieve humidification of the sheet without negatively affecting the sheet conveyance.

(2) In (1), when a sheet is conveyed while being humidified and sandwiched by the pair of humidification rollers, the contacting state of the humidification roller with respect to the sheet is changed to switch between the first humidification amount and the second humidification amount. Consequently, it is possible to reduce the situation where the front end region of the sheet easily winds around the humidification roller under the influence of the water of the surface of the humidified sheet. Thus, it is possible to achieve humidification of the sheet without negatively affecting the sheet conveyance.

In addition, in (1), when a sheet is conveyed while being humidified and sandwiched by the pair of humidification rollers, the state of water supply to the humidification roller by the water supply section is changed to switch between the first humidification amount and the second humidification amount. Consequently, it is possible to reduce the situation where the front end region of the sheet easily winds around the humidification roller under the influence of the water of the surface of the humidified sheet. Thus, it is possible to achieve humidification of the sheet without negatively affecting the sheet conveyance.

(3) In (2), when a sheet is conveyed while being humidified and sandwiched by the pair of humidification rollers, the sheet sandwiching pressure or the sheet sandwiching distance of the pair of humidification rollers is adjusted to switch between the first humidification amount and the second humidification amount. Consequently, it is possible to reduce the situation where the front end region of the sheet easily winds around the humidification roller under the influence of the water of the surface of the humidified sheet. Thus, it is possible to achieve humidification of the sheet without negatively affecting the sheet conveyance.

(4) In (3), when a sheet is conveyed while being humidified and sandwiched by the pair of humidification rollers, the sheet sandwiching pressure or the sheet sandwiching distance of the pair of humidification rollers is adjusted to change a contact area of the sheet and the humidification roller, thereby switching between the first humidification amount and the second humidification amount. Consequently, it is possible to reduce the situation where the front end region of the sheet easily winds around the humidification roller under the influence of the water of the surface of the humidified sheet. Thus, it is possible to achieve humidification of the sheet without negatively affecting the sheet conveyance.

(5) In (2) to (4), the timing of switching from the first humidification amount to the second humidification amount is controlled with reference to the diameter of the humidification roller. Consequently, it is possible to appropriately reduce the situation where the front end region of the sheet easily winds around the humidification roller under the influence of the water of the surface of the humidified sheet. Thus, it is possible to achieve humidification of the sheet without negatively affecting the sheet conveyance.

(6) In (2) to (5), the first humidification amount is determined with reference to the diameter of the humidification roller. Consequently, it is possible to appropriately reduce the situation where the front end region of the sheet easily winds around the humidification roller under the influence of the water of the surface of the humidified sheet. Thus, it is possible to achieve humidification of the sheet without negatively affecting the sheet conveyance.

(7) In (1) to (6), the timing of switching from the first humidification amount to the second humidification amount is determined with reference to the second humidification amount. Consequently, it is possible to appropriately reduce the situation where the front end region of the sheet easily winds around the humidification roller under the influence of the water of the surface of the humidified sheet. Thus, it is possible to achieve humidification of the sheet without negatively affecting the sheet conveyance.

(8) In (1) to (7), the timing of switching from the first humidification amount to the second humidification amount is controlled with reference to the type of the sheet. Consequently, it is possible to appropriately reduce the situation where the front end region of the sheet easily winds around the humidification roller under the influence of the water of the surface of the humidified sheet. Thus, it is possible to achieve humidification of the sheet without negatively affecting the sheet conveyance.

(9) In (1) to (8), the timing of switching from the first humidification amount to the second humidification amount is controlled with reference to the image formation condition in the case where an image has been formed on the sheet. Consequently, it is possible to appropriately reduce the situation where the front end region of the sheet easily winds around the humidification roller under the influence of the water of the surface of the humidified sheet. Thus, it is possible to achieve humidification of the sheet without negatively affecting the sheet conveyance.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A sheet humidification apparatus comprising: a detect sensor that detects a position of a sheet which is being conveyed; a humidifier that changes a humidification amount and humidifies the sheet; and a controller that controls the humidifier such that a first region on a side of a front end side of the sheet in a conveyance direction is humidified with a first humidification amount, and a second region on the same side of the sheet other than the first region is humidified with a second humidification amount larger than the first humidification amount in accordance with a position of the sheet detected by the detect sensor.

2. The sheet humidification apparatus according to claim 1, wherein the humidifier includes a pair of humidification rollers that humidify the sheet when the sheet is conveyed in a sandwiching manner, and the controller switches between the first humidification amount and the second humidification amount by changing a contacting state of the humidification rollers with respect to the sheet.

3. The sheet humidification apparatus according to claim 2, wherein the humidifier further includes a sandwiching adjuster that adjusts a sandwiching pressure or a sandwiching distance of the sheet of the humidification rollers, and the controller adjusts the sandwiching pressure or the sandwiching distance of the humidification rollers by the sandwiching adjuster to change the contacting state and switch between the first humidification amount and the second humidification amount.

4. The sheet humidification apparatus according to claim 3, wherein the controller adjusts the sandwiching pressure or the sandwiching distance of the humidification rollers by the sandwiching adjuster and changes a contact area of the sheet and the humidification rollers to switch between the first humidification amount and the second humidification amount.

5. The sheet humidification apparatus according to claim 2, wherein the controller refers to a diameter of the humidification rollers to control a timing of switching between the first humidification amount and the second humidification amount.

6. The sheet humidification apparatus according to claim 2, wherein the controller refers to a diameter of the humidification rollers to determine the first humidification amount.

7. The sheet humidification apparatus according to claim 1, wherein the controller refers to the second humidification amount to control a timing of switching between the first humidification amount and the second humidification amount.

8. The sheet humidification apparatus according to claim 1, wherein the controller refers to a type of the sheet to control a timing of switching between the first humidification amount and the second humidification amount.

9. The sheet humidification apparatus according to claim 1, wherein the controller refers to an image formation condition in a case where an image is formed on the sheet to control a timing of switching between the first humidification amount and the second humidification amount.

10. A humidification control method in a sheet humidification apparatus including a detect sensor that detects a position of a sheet which is being conveyed, a humidifier that changes a humidification amount and humidifies the sheet, and a controller that controls the humidifier to humidify the sheet, the method comprising: causing the controller to control the humidifier such that a first region on a side of a front end side of the sheet in a conveyance direction is humidified with a first humidification amount, and a second region on the same side of the sheet other than the first region is humidified with a second humidification amount larger than the first humidification amount in accordance with a position of the sheet detected by the detect sensor.

11. The method according to claim 10, wherein the humidifier includes a pair of humidification rollers that humidify the sheet when the sheet is conveyed in a sandwiching manner, and the controller operates to change a contacting state of the humidification rollers with respect to the sheet to switch between the first humidification amount and the second humidification amount.

* * * * *